United States Patent [19]

Voecks, Jr.

[11] Patent Number: 4,491,312

[45] Date of Patent: Jan. 1, 1985

[54] AUTOMATIC FEEDER-LOADER FOR CUT SHEET PAPER

[75] Inventor: William F. Voecks, Jr., Winter Park, Fla.

[73] Assignee: Burroughs Corporation, Detroit, Mich.

[21] Appl. No.: 378,486

[22] Filed: May 14, 1982

[51] Int. Cl.[3] ..... B65H 1/08

[52] U.S. Cl. ..... 271/127; 271/159; 271/160; 271/162

[58] Field of Search ..... 271/110, 111, 117, 127, 271/157, 158, 159, 160, 162

[56] References Cited

U.S. PATENT DOCUMENTS

| | | | |
|---|---|---|---|
| 1,850,108 | 3/1932 | Hunter | 271/162 X |
| 4,060,233 | 11/1977 | Stange | 271/127 X |
| 4,387,889 | 6/1983 | Koyama | 271/162 X |
| 4,406,448 | 9/1983 | Kulpa | 271/127 X |

*Primary Examiner*—Richard A. Schacher

*Attorney, Agent, or Firm*—Carl Fissell, Jr.; Edmund M. Chung; Kevin R. Peterson

[57] ABSTRACT

A sheet item reloader-feeder wherein a pivoted item receiving tray is arcuately-angularly movable from a load position in which the tray is empty to a feed position in which the tray is full. A coiled spring biases the item tray vertically to bring the top most sheet item into the nip of a feeding device. A cable connected to the tray is interconnected to an over-center spring biased cam and an external tray handle whereby movement of the handle causes the tray to automatically move against the tension of the biasing spring from the empty position to the loaded position bring the top most sheet item into the nip of the feeding device for automatic feeding. Two such reloader-feeder devices are stacked in vertical offset relation to one another permitting operator reloading during feeding without stopping the operation of the apparatus.

7 Claims, 9 Drawing Figures

AUTOMATIC FEEDER-LOADER FOR CUT SHEET PAPER

BACKGROUND OF THE INVENTION

1. Field of the Invention

The present invention relates to sheet item feeders and loaders and more specifically to a novel cut sheet item loader utilizing an over-under, spring biased handling mechanism.

2. Description of the Prior Art

Feeding cut sheet items such as stacked sheets of regular or ordinary $8\frac{1}{2}\times 11''$ bond paper requires that the leading edge of the top sheet of the stack be placed close to or physically at the "nip" of the feeding device so that the sheets can be fed automatically in succession without additional handling by the operator. Means must also be provided for causing the stack to move as the stack is depleted due to feeding so that all sheets are fed without overlap, jam or misfeed.

Prior art devices have relied upon jogger-feeder beds on which the paper stack is first placed and thereafter fed or, upon box-like input hoppers having outfeed rollers at one side thereof or, a variety of biasing mechanisms for constantly elevating the sheet stack as the feeding is performed.

Where, as in the present feeding mechanism, sheet items are to be loaded from in front of the base machine and wherein the paper is also replenished from in front, none of the prior art Mechanisms are entirely satisfactory since each has one or more limitations which tend to interfere with the efficient operation of the apparatus or make the handling of the paper inconvenient, time consuming and relatively inefficient.

SUMMARY OF THE INVENTION

The present invention solves these and other associated problems in a new, novel and heretofore unobvious manner by providing a flat, pivotally mounted sheet item support adjacent to a rotary feeder mechanism including a feeding wheel and a backup roller. The support is hinged at one edge and includes handling means normal to the plane of the support. The handling means is provided with an over-center, spring biased cam means, cable connected to the support such that when the handling means is moved, a central, vertical biasing spring is effective accurately to raise and lower the sheer support so as to bring the leading edge of each sheet into the "nip" of the operably associated rotary feeder. The over-center cam permits the sheet support to remain in one or the other of two fixed positions. In one position the bed of the loading tray support is in a position to admit fresh items onto the support. While in the other fixed position the bed or feeding support is raised against the tension of the spring and the weight of the paper so that the sheets of paper are angled into the "nip" of the feeding device relative to the support.

In order to increase the throughput of the device while avoiding the usual down time for loading fresh item stacks the present invention incorporates two stacked feeding loader units one over the other with the upper one slightly displaced forwardly over the other thus permitting a continuous uninterrupted item flow as a result of software switching from one to the other of the two feeders. Additionally, the present invention is less expensive to fabricate-and assemble than the typical up-down elevator mechanism in common use. Also, due to the simplified construction the present invention permits the feeding of a wide variety of sheet item sizes which lessen the cost of individual operator owner preference.

DESCRIPTION OF THE PREFERRED EMBODIMENT

Figures 1, 1A:
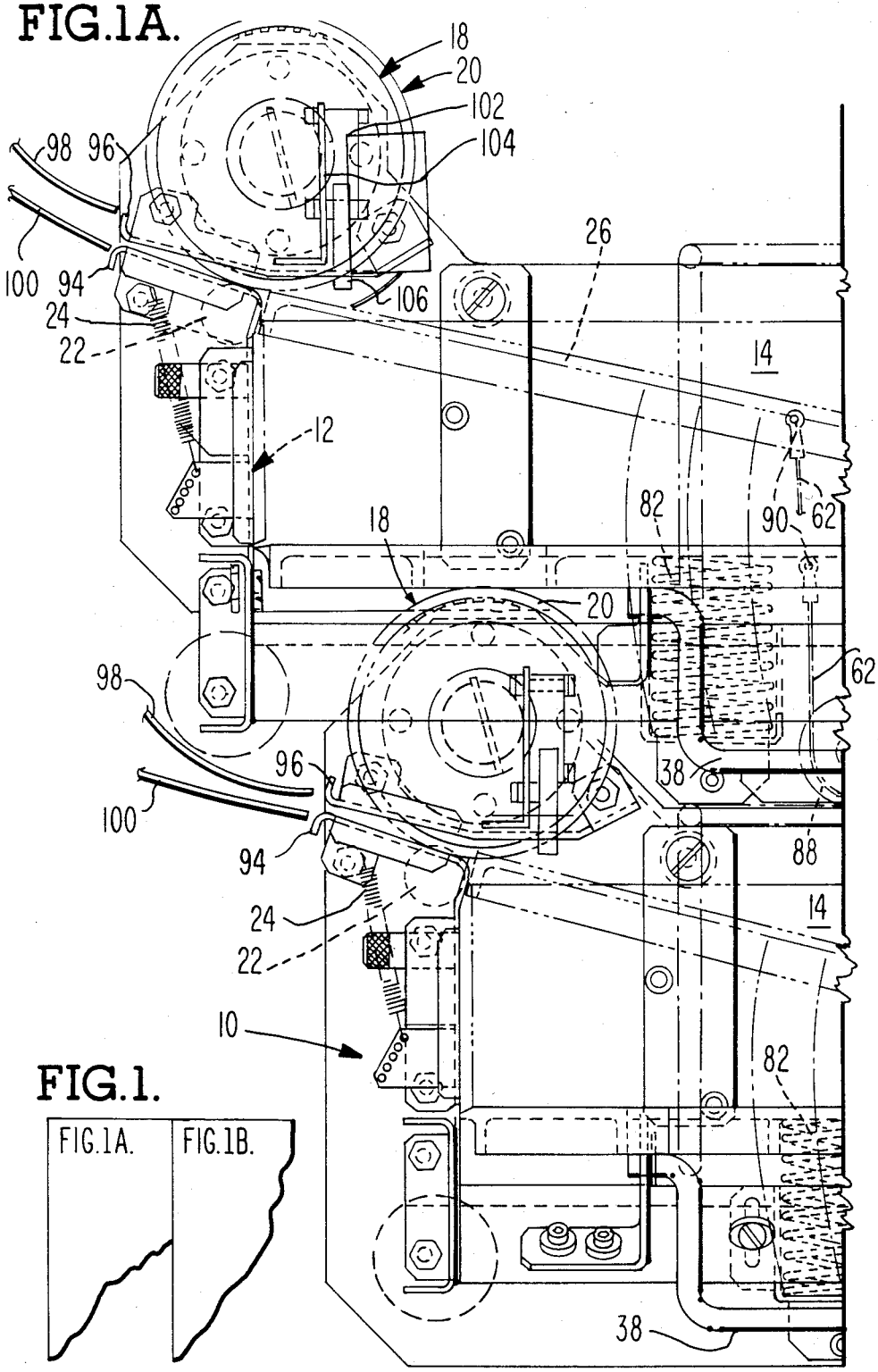
FIG. 1 is a plan of the sheet arrangement for FIGS. 1*a* and 1*b;*
FIGS. 1*a* and 1*b* taken together constitute a front elevational view of the stacked feeders of the present invention.
Figure 1B:
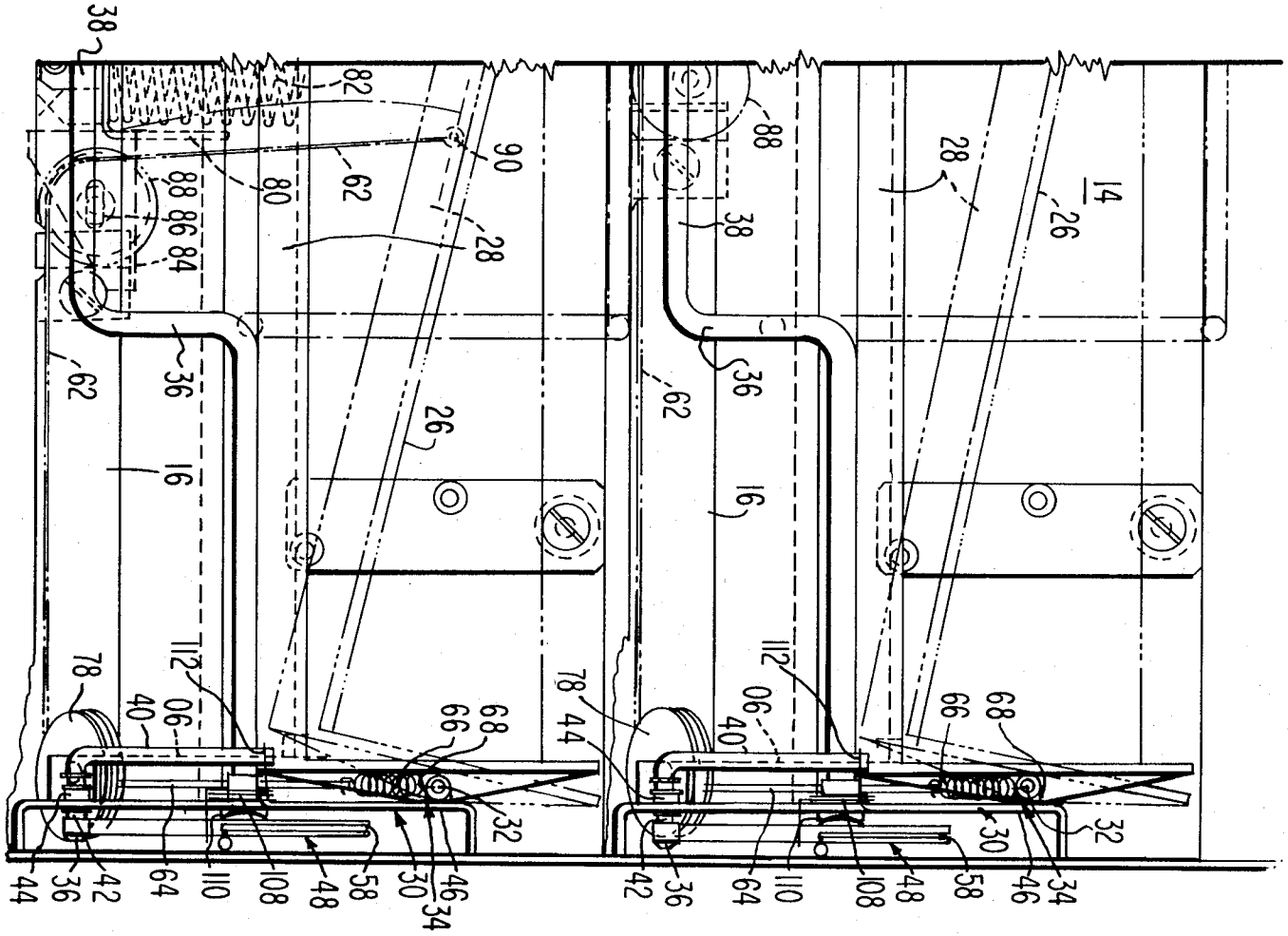

Referring to FIGS. 1*a* and 1*b* the reloader feeder elevator of the present invention comprises a box-like support or frame 10 including left side wall member 12 backwall member 14 and bottom or floor member 16. A rotary feed wheel 18 having a resilient tired surface 20 is rotatably disposed at the upper left of the support 14 and is disposed in surface contact with an idler roller 22 biased by spring 24 against tired surface 20, providing a feeding "nip" for the sheet items 26.

A flat, angularly disposed item support tray 28 is hingedly pivoted at its rightward end to the right hand wall structure 30 by means of pivot pin 32 and bracket 34 thereby permitting the leftward free end of tray 28 to move arcuately, angularly up and down relative to the floor member 16 against the tension of a biasing spring 82 so as to bring the leftward edge of member 28 adjacent to the "nip" between feed wheel 18 and backup roller 22. Wall member 30 is a relatively wide U-shaped sheet metal member extending outwardly, forwardly, perpendicular to the back wall member 14.

Disposed across the front of the structure 10, for operator convenience, is handling member 36, with a central U-shaped bent out portion 38 forming a gripping handle by means of which an operator can load fresh paper stock onto the support tray 28. Member 36 is rotatably pivoted at its leftward end in wall member 12 and is secured against dislodgment by an E-ring. The rightward end of member 36 is journaled in member 30 and includes, a forwardly extending L-shaped cam actuator member 40, the lower horizontally extending portion 42 of which is provided with a flexible bumper member 44, for purposes to be explained presently.

Figure 3:
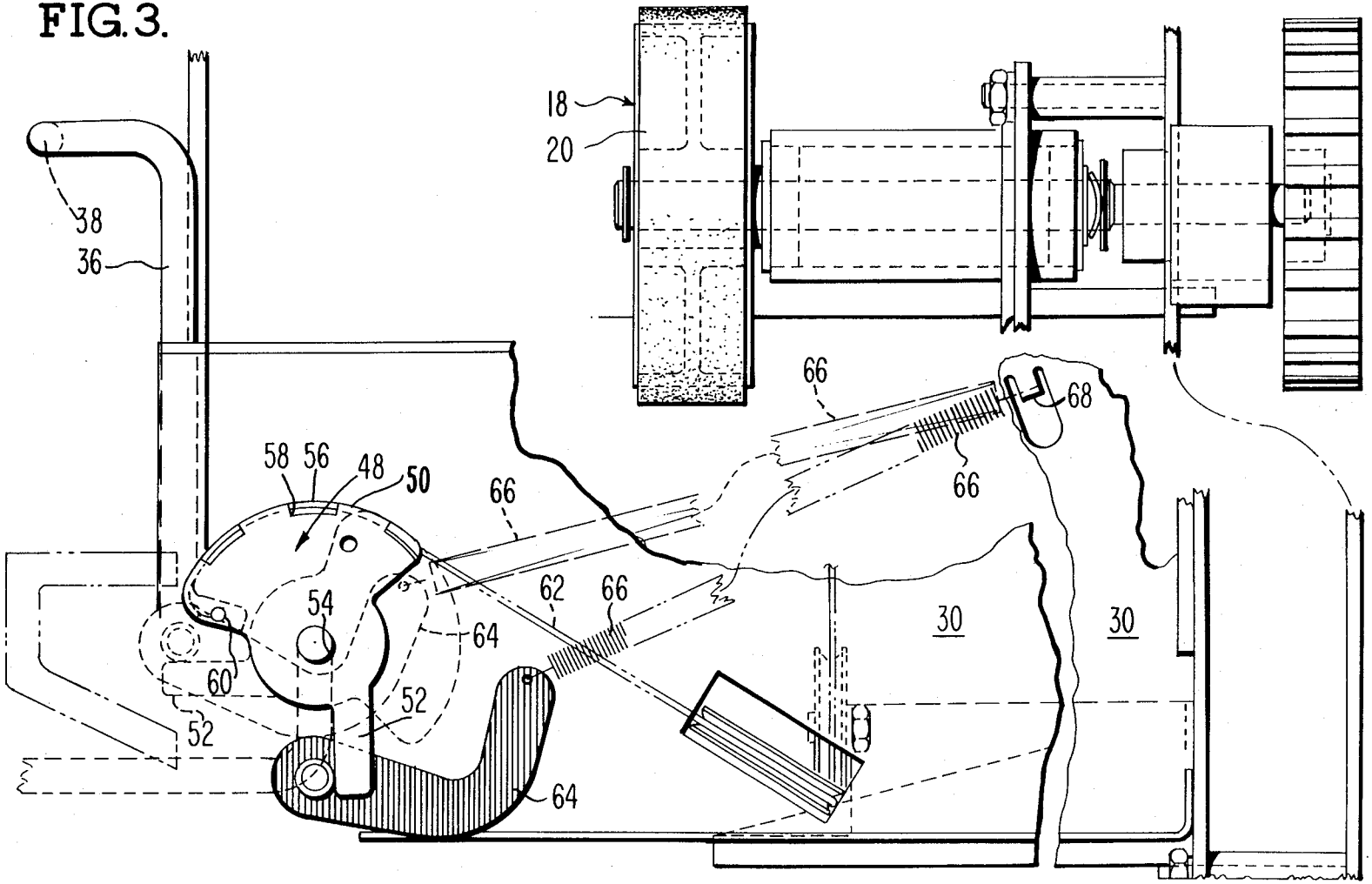
* and FIG. 3 is a partial sectional view of the elevating cam mechanism for the present invention.

Disposed on the rightward end of member 36, exteriorly of the elongated vertical portion 46 of wall member 30 is an irregularly shaped cable cam member 48, pivotally rotatable on member 36 which as viewed in FIG. 3, has a fan or wedge shaped portion 50 and an elongated rectangular leg portion 52 with a central mounting aperture 54 therein for attachment of the cam to the end of member 36. The periphery of the fan or wedge portion 50 is segmented as shown into a number of rectangular alternating offset areas or castellations 56 with a angular trough or groove 58 extending between the pairs of tooth-like members 56 forming a cable receiving groove therein. One end of fan shaped member 50 includes a hook element 60 for receiving the end of an operably associated cable member 62, for purposes to be explained shortly herein.

Inboard, or to the left of right hand wall member 30, as seen in FIG. 3, is an L-shaped spring arm 64 rockably, pivotally mounted to the end of member 42 by means of E-rings. The inboard end of member 64 carries one end of an over center spring 66, the opposite end of which is secured to the inboard portion of wall 30 by means of a bent out tab or tang 68 (FIGS. 3 and 4).

As seen most clearly in FIGS. 3 and 4 the forward lower corner of right side wall member 30 (as viewed by the right side) is notched or cut away to provide clearance for the arcuate rotation of cam control member 42, FIG. 1*b* as will be explained shortly. Aperture 70 provides mounting means for the rightward end of the handle shaft 36. Upper and lower stops for the arcuate movement of the control member 42 are seen as sheet metal tangs 72 and 74, respectively, bent, pressed or stamped out of the plane of wall member 30.

Figures 2, 2A:
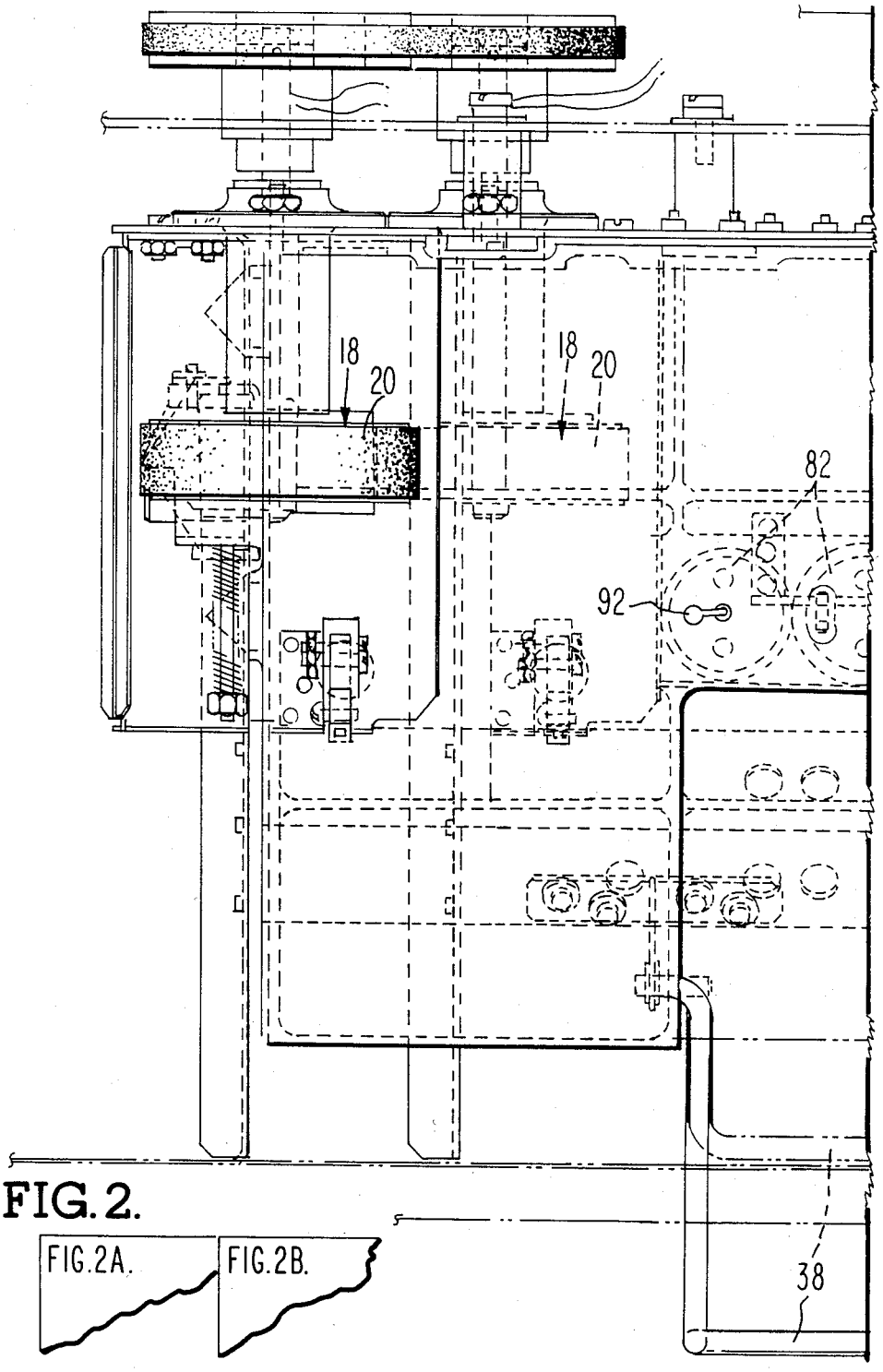
FIG. 2 is a plan of the sheet arrangement for FIGS. 2*a* and 2*b;*
FIGS. 2*a* and 2*b* taken together constitute a top plan view of the stacked feeder mechanism of FIGS. 1*a* and 1*b.
Figure 2B:
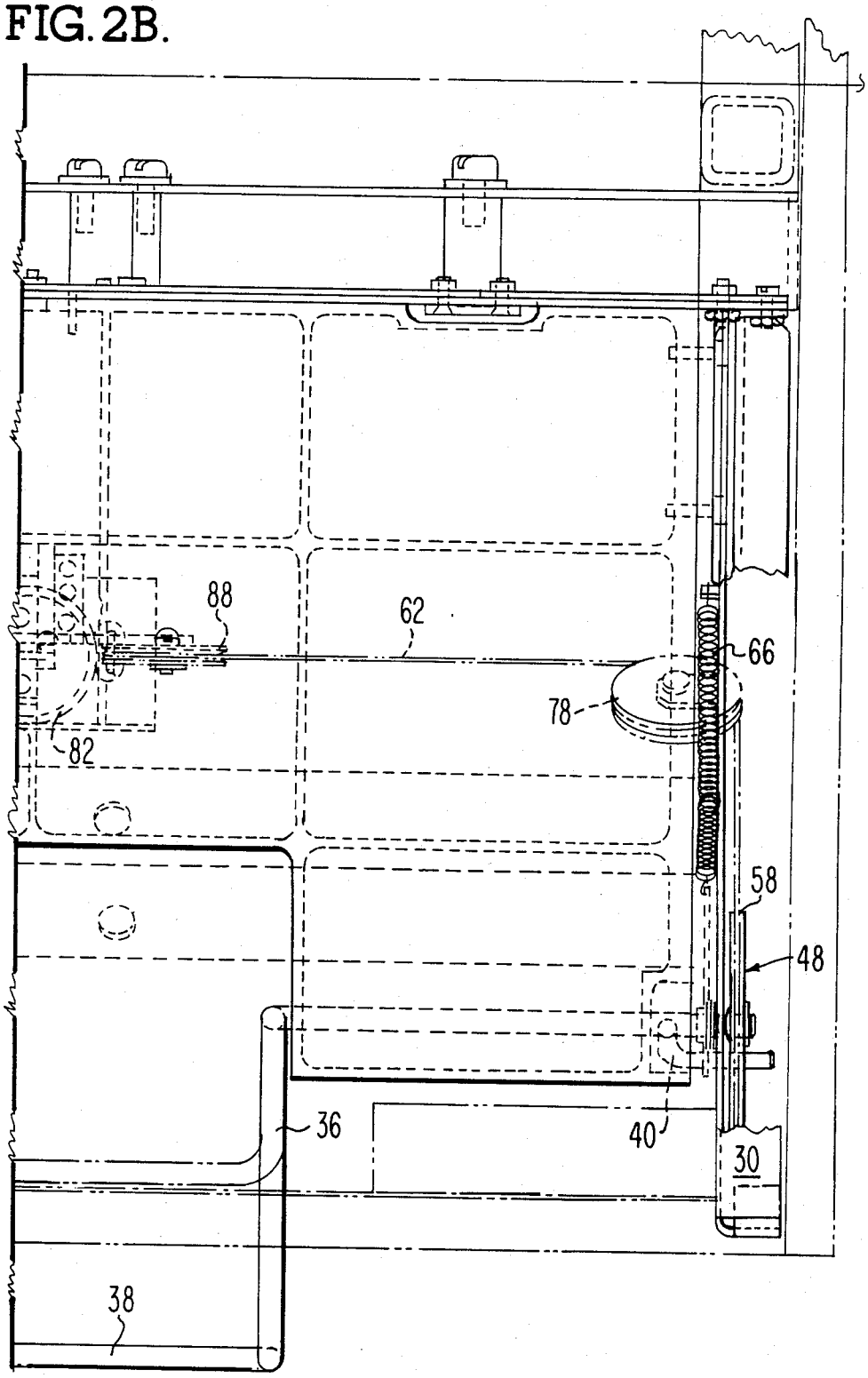
Figure 4:
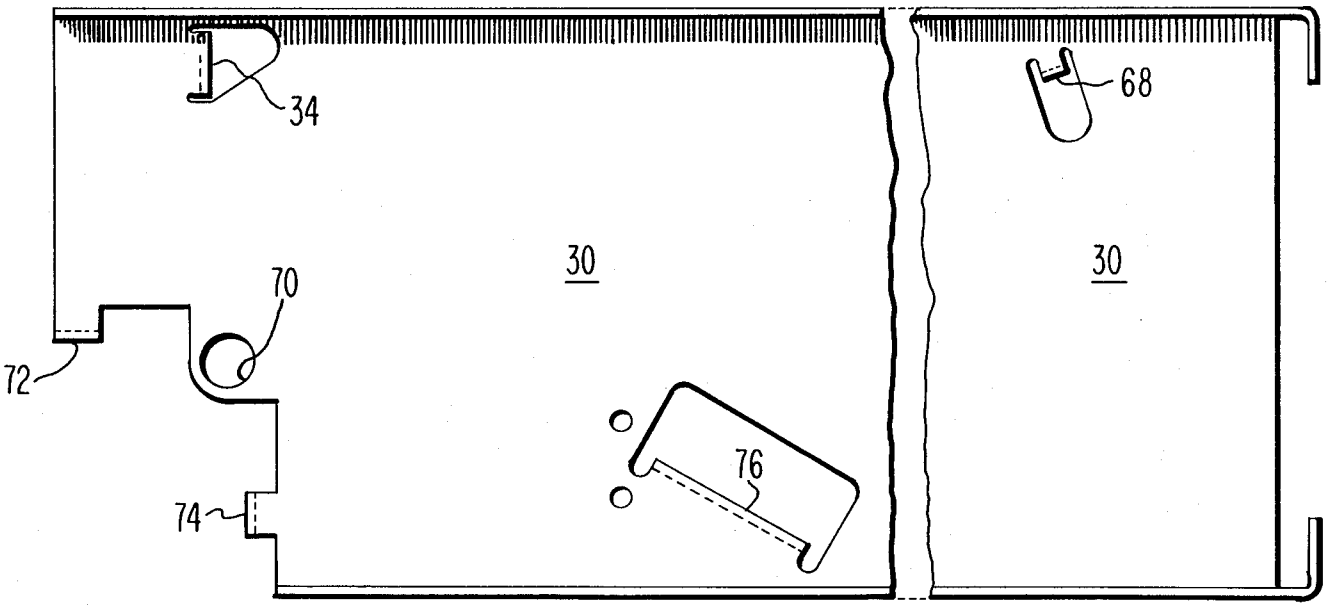
FIGS. 4, 4*a* are different views of the U-shaped sheet metal wall structure.
Figure 4A:
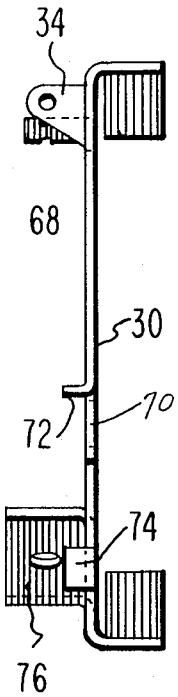

Intermediate the front and rear edges of side wall member 30 is a sheet metal support 76 FIGS. 4, 4*a* stamped and bent out of the plane or wall 30, which acts as a mounting member for rotatably supporting a first grooved, cable guide roller 78 FIG. 1*b*. Midway between the two side walls 12 and 30 as seen from in front, FIG. 1*b*, is a shallow sheet metal well 80 for supporting a relatively large coiled spring 82 for biasing member 28, as previously mentioned. Rightwardly of spring support 80 is a rightwardly extending bracket 84 provided with an adjusting aperture or slide 86 to which is mounted a second grooved cable guide pulley 88. As shown, the two pulleys are rotatable in two different planes relative to each other and to the plane of the cable cam 48. This arrangement of cable pulley offset is utilized in order to change direction of the pulley drive cable 62 as it moves from the cable cam 48 to the support tray 28 to which it is attached by a removable cross pin 90 FIG. 1*b* in a slot 92, FIG. 2*a* in tray 28. Cable 62 is secured to the tray and then is run downwardly and around pulley 88 and across the half length of the support tray 28, around angled pulley 78 and up over the top of cable cam 48, and around to the cable attachment 60 where it is securely fastened.

The left side wall 12 is curved outwardly at its upper extremity, i.e. bent leftwardly to provide a lower, upwardly slanted or canted item sheet guide 94. An upper guide 96 is slotted and disposed beneath the feed wheel 18 and arranged adjacent to guide member 94 so as to form an item receiving throat opening leftwardly into a secondary set of sheet item guides 98 and 100, upwardly curved so as to cause the sheet items to move upwardly into the printing copying area (not shown).

A paper sensing microswitch 102 is secured to a mounting bracket 104 adjacent to the rear of the feed wheel 18 with the actuator arm 106 arranged to extend downwardly at an angle into contact with the sheet item stack 26. By this means when the tray is empty of items the arm 106 is adapted to extend downwardly through an opening not shown in tray 28 so that the presence or absence of sheet items 26 are determined and appropriate electrical signals are forwarded to the software portion of the apparatus (not shown) so as to cause feeding or to stop feeding for loading, as the case may be. As, seen in the lower right corner of FIG. 1*b* a multi-coiled torsion spring 108 has one end 110 abutting the long leg 52 of cable cam 48 while the opposite end 112 of spring 108 abuts the extension of handle 36. This spring 108 acts to keep the cable 62 taut so that it cannot unwind from around the cable cam 48 or from around the two cable directing pulleys 78 and 88.

As earlier mentioned the present apparatus is constructed as a dual feed-loader stack-up arrangement, as shown in FIGS. 1*a* and 1*b*. The two feeder-loader units are vertically offset from one another, as shown, so as to permit continual item feeding by means of multiple serial feeds without stopping the machine. It is also noted that the platform tray 28 can be fabricated in such a fashion as to permit the feeder loader to accommodate varying sizes and lengths of sheet items.

OPERATION

In operation of the device the handle portion 38 is first rocked downwardly from its vertical position into the "load" position in which the paper item support tray 28 is substantially horizontal. Thereafter paper 26 is loaded on board tray 28. At this point in the operation the elements of the structural arrangement are as shown in full line in FIG. 1*a* and 1*b* with the over center cable arm spring 66 angled downwardly (FIG. 3). The bumper member 44 rests against the stop member 74 FIG. 4. Once the operator has completely loaded both feeders the handle member 36 is raised vertically upwardly which causes the cable cam 48 to rotate clockwise simultaneously causing the spring arm 64 to move into its upper over-center position as shown in dotted outline in FIG. 3 with member 44 now resting against stop 72. Meanwhile, the large coiled spring 82 has permitted the tray 28 to raise upwardly against the weight of the paper which in turn brings the paper stack vertically-angularly upwardly so as to angle the first or top most sheet into contact with feed wheel tired surface 20. The spring actuator arm 106 of micro-switch 102 now rests on the top surface of the top sheet indicating to the software (not shown) that the apparatus is ready for feeding. With the proper signal from the feed control, energization of the driving motor and feed clutch (not shown), the feed wheel 18 will cause the sheets to be automatically fed first from the top most feeder loader and subsequentially when that feeder loader is emptied from the bottom feeder loader. Meanwhile, as the bottom feeder loader is being utilized as a feeding device the upper feeder loader can be operator reloaded. As is apparent from the foregoing this novel arrangement permits continuous feeding without interruption even though the feeders are alternately loaded and emptied, etc.

What is claimed is:

1. Automatic feeder-loader apparatus for cut sheet items comprising:

a sheet item tray pivotally movable from a load position in which said tray is normally empty to a feed position in which said tray is full and wherein the top most sheet item is positioned at the nip of a feeding device;

biasing means in contact with said tray for biasing said tray upwardly from the load to the feed position;

over-center means coupled to said item tray movable between two stable semi-fixed positions and including means biasing said over center means into one or the other of said fixed positions; and an operably movable handle interengaging and coupling said tray and said over center means alternatively for blocking access to said tray when in said feed position and for unblocking access to said tray when in said load position.

2. The invention in accordance with claim 1 wherein said over-center means further comprises a cam and spring arranged relative to each other to provide two opposite semi-fixed stable positions for said item tray.

3. The invention in accordance with claim 1 wherein said coupling means further comprises an elongated cable interconnecting said over-center means and said tray and means for changing direction of said cable.

4. The invention in accordance with claim 3 wherein said direction changing means includes two substantially orthogonally arranged members over which said cable is moved from said over-center means to said item tray for converting vertical to horizontal motion.

5. The invention in accordance with claim 2 wherein said cam comprises a fan shaped member the outer periphery of which is castellated and grooved to receive a cable and including attachment means for said cable and wherein said means for moving said tray includes a pivoted handle one end of which engages said cam.

6. The invention in accordance with claim 5 further including biasing means engaging said cam and said pivoted handle for applying suitable tension to said cable to prevent cable slack.

7. The invention in accordance with claim 1 further comprising a second automatic feeder-loader stacked vertically above a first automatic feeder loader and horizontally offset from said first feeder loader a sufficient distance to avoid interference therewith including switch control means for selectively energizing first one and then the other feeder as the item tray is emptied and filled.

* * * * *